US008967913B2

(12) United States Patent
Lajugie et al.

(10) Patent No.: US 8,967,913 B2
(45) **Date of Patent: *Mar. 3, 2015**

(54) RETRACTABLE CHAIN CONNECTOR

(71) Applicant: Single Buoy Moorings Inc., Marly (CH)

(72) Inventors: Ioannis Mikis Lajugie, Nice (FR); Jean-Baptiste Yves Hames, Nice (FR); Sebastien Jean-Francois Truchi, Nice (FR)

(73) Assignee: Single Buoy Moorings Inc., Marly (CH)

( * ) Notice: Subject to any disclaimer, the term of this patent is extended or adjusted under 35 U.S.C. 154(b) by 0 days.

This patent is subject to a terminal disclaimer.

(21) Appl. No.: 13/866,124

(22) Filed: Apr. 19, 2013

(65) Prior Publication Data

US 2013/0230359 A1 Sep. 5, 2013

Related U.S. Application Data

(63) Continuation-in-part of application No. 13/825,556, filed as application No. PCT/EP2011/066609 on Sep. 23, 2011.

(30) Foreign Application Priority Data

Sep. 23, 2010 (EP) ..... 10178963

(51) Int. Cl.
*B63B 21/50* (2006.01)
*B63B 21/10* (2006.01)
*B63B 21/18* (2006.01)

(52) U.S. Cl.
CPC ..... *B63B 21/502* (2013.01); *B63B 21/10* (2013.01); *B63B 21/18* (2013.01); *B63B 21/507* (2013.01); *B63B 2221/22* (2013.01)
USPC ..... 405/224; 114/293; 114/230.12

(58) Field of Classification Search
CPC ..... B63B 21/50; B63B 21/502; B63B 21/507
USPC ..... 405/224, 224.2, 224.3, 224.4; 114/230.12, 293
See application file for complete search history.

(56) References Cited

U.S. PATENT DOCUMENTS

| | | | | |
|---|---|---|---|---|
| 3,602,175 | A | 8/1971 | Morgan et al. | |
| 3,620,181 | A * | 11/1971 | Naczkowski | 114/293 |
| 5,823,131 | A | 10/1998 | Boatman et al. | |
| 5,845,893 | A * | 12/1998 | Groves | 114/293 |
| 6,663,320 | B1 * | 12/2003 | Braud et al. | 405/224 |

(Continued)

FOREIGN PATENT DOCUMENTS

| | | |
|---|---|---|
| EP | 2 154 059 | 2/2010 |
| GB | 2 351 058 | 12/2000 |

(Continued)

*Primary Examiner* — Frederick L Lagman
(74) *Attorney, Agent, or Firm* — Young & Thompson

(57) ABSTRACT

A mooring leg connector (4) is configured for use with a mooring chain part (3) of a mooring leg extending up from the sea floor to moor a floating structure (1) to the seabed. The connector has an elongate tubular element (5) extending in the mooring leg direction and a latch mechanism (6) for fixation of the mooring chain part to the floating structure to be moored and preventing movement along the mooring leg in the direction of the seabed. The elongate tubular element has a passage for the mooring chain to pass through and includes at the top a double articulation axis including a roll articulation (7) and a pitch articulation (8). The roll and pitch articulations are coplanar.

11 Claims, 6 Drawing Sheets

(56) References Cited

U.S. PATENT DOCUMENTS

| | | | | |
|---|---|---|---|---|
| 6,925,890 | B2 * | 8/2005 | Fontenot | 73/828 |
| 6,990,917 | B2 * | 1/2006 | Boatman et al. | 114/230.12 |
| 7,104,214 | B2 * | 9/2006 | Niebur | 114/293 |
| 7,325,508 | B2 * | 2/2008 | Boatman et al. | 114/293 |
| 7,421,967 | B1 | 9/2008 | Fontenot | |
| 7,926,436 | B2 * | 4/2011 | Boatman et al. | 114/230.2 |
| 2003/0121465 | A1 * | 7/2003 | Boatman et al. | 114/230.12 |
| 2006/0213418 | A1 | 9/2006 | Boatman et al. | |
| 2008/0166936 | A1 | 7/2008 | Lindblade | |

FOREIGN PATENT DOCUMENTS

| | | |
|---|---|---|
| WO | 99/17983 | 4/1999 |
| WO | 00/78599 | 12/2000 |

* cited by examiner

RETRACTABLE CHAIN CONNECTOR

FIELD OF THE INVENTION

The invention relates to a mooring leg connector for use with a mooring leg that has an upper portion with an axis, where the mooring leg extends up from the sea floor, to connect a floating body to the seabed. The invention further relates to an offshore construction comprising such a connector and a method to retract such a connector when disconnected.

BACKGROUND OF THE INVENTION

Such an offshore construction is known from WO 00/78599 in which a mooring buoy is disclosed which is anchored to the seabed in which the anchor chains are attached to the buoy via a pivoting chain receiving tube comprising a chain stopper by which the chain can be tensioned. By providing two orthogonal pivot axes for the chain tensioner, chain wear can be reduced and the tension in the chain upon movement of the buoy is decreased.

As is known generally, floating devices such as vessels or floating offshore structure, for example in the oil and gas industry, are moored to the seabed with one or more mooring lines. The floating device is kept on location because of the catenary effect of the mooring chains. A shift of the floating device leads to a lifting or lowering of the mooring chains, which leads to a counter effect striving to re-establish the original position of the floating device. The floating device is provided with a mooring chain connector assembly for each mooring chain, wherein the first pivot axis allows motions of the mooring chain in its catenary plane (so-called "in-plane motions"). It is also known to provide a second pivot axis, typically perpendicular to the first pivot axis, which second axis allows motions of the mooring chains in a transverse direction (so-called "out-of-plane motions"). In this manner fatigue problems in the mooring chain related to any motions of the mooring chain are minimized.

Mooring chain connector assemblies of this type are described for example in U.S. Pat. No. 6,663,320 filed by the applicant.

In U.S. Pat. No. 7,926,436 there is described a chain support hinged on two perpendicular axes which allows chain movement in two perpendicular planes. The chain support provides an improved arrangement to allow chain to be pulled through the center of the apparatus to a desired length after which the chain is removably secured to the chain support. In the known mooring chain connector assemblies, the dual axes are not coplanar which creates a moment from one articulation to the other.

The present invention provides a solution where moments between articulations will be avoided as well as load supported by the connector.

According to the present invention, the out of plane bending can be fully controlled and retensioning can be operated directly from the floating device. The solution proposed is ideal for weathervaning floating device but is also easily adaptable for spread moored floating device.

Further according to the present invention, the chain is protected against corrosion and the sling arrangement is simplified.

SUMMARY OF THE INVENTION

The object of the present invention is to provide a mooring leg connector for use with a mooring chain part of a mooring leg extending up from the sea floor to moor a floating structure to the seabed, said connector having an elongate tubular element extending in the mooring leg direction and a latch mechanism for fixation of the mooring chain part to the floating structure to be moored and preventing movement along the mooring leg in the direction of the seabed, the elongate tubular element has a passage for the mooring chain to pass through and comprises at the top a double articulation axis comprising a roll articulation and a pitch articulation characterized in that the roll and pitch articulations are coplanar.

Another object of the present invention is that the double articulation axis of the chain connector comprises a roll body that rolls inside a pitch body which pitches inside roll blocks by means of trunnions, the latch mechanism preferably resting on the top of the roll body.

A further advantage of the present invention is that the gap between the bottom of the elongate tubular element and the mooring chain passing through is closed by an element placed at the bottom end of the elongate tubular element, the passage in the elongate tubular element for the mooring chain to pass through also comprising a guiding element with a cruciform shape opening which is placed just before the latch mechanism.

The object of the present invention is also to provide a mooring chain connector assembly for a spread moored floating device comprising, for each mooring line, a guiding wheel and a fairlead installed on the hull of the floating device in combination with the chain connector of the present invention.

BRIEF DESCRIPTION OF THE DRAWINGS

The invention will be further described below in connection with exemplary embodiments with reference to the accompanying drawings, wherein

FIG. 1 schematically shows a FPSO vessel 1 or floating body, comprising a turret 2, which is anchored to the seabed by means of a plurality of mooring lines 3 in a usual manner. The FPSO vessel 1 is adapted to weathervane around the turret 2. It is noted that the wording mooring chain and mooring line as used in the specification and claims may be any type of mooring means such as chains, wires, a combination thereof or the like. Each mooring line 3 is connected to the turret 2 by means of a mooring chain connector assembly 4 having two mainly perpendicular pivot axes to accommodate motions of the mooring line in its catenary plane (in-plane motions) and transverse to this plane (out-of-plane motions). In this manner fatigue problems which may lead to failure of the line are minimized.

The mooring chain connector assembly 4 is shown at a larger scale in FIGS. 2, 3*a* and 3*b* and 4. In FIG. 1 one disconnected connector 4*a* is shown. Once disconnected, the chain connector 4*a* has been retracted. Therefore in comparison with the connected chain connector 4*b*, the main part of the connector tubular body 5*a* of the connector 4*a* is within the turret 2 whereas the main part of the connector tubular body 5*b* of the connector 4*b* is below the hull of the vessel 1.

FIG. 2 shows an overview of a connector according to the present invention. The chain connector 4 is part of the FPSO mooring system. The chain is stopped by a latch mechanism or ratchet 6 which lies on the roll body 7. The roll body 'rolls' inside the pitch body 8 which 'pitches' inside the roll blocks 9, by means of trunnions. The roll blocks 9 are mounted inside the housing 10. These housings are mounted into the chain table castings (not shown) with an intermediate resin layer to level out the chain table fabrication offsets. When the chain is not stopped by the chain connector, the ratchet 6 stays at opened position by means of a counterweight 11 and can be closed by means of a vertical chain winch (not shown).

FIGS. 3*a* and 3*b* show side views of a connector according to one possible embodiment of the present invention when not retracted and when retracted. In FIGS. 3*a* and 3*b* it appears clearly that the part 20 comprising the ratchet 6 and counterweight 11, the double articulation assembly 7, 8 having two mutually perpendicular pivot axes and a housing 10 is fixed with regards to the floating body 1 whereas the part 30 comprising the elongate tubular member 5 extending in the anchor line direction is movable with regards to the floating body 1 (represented by the axis 12).

In a further embodiment, the moveable part 30 is designed in such a way that the moveable part 30 is completely removable from the fixed part 20.

Figure 1:
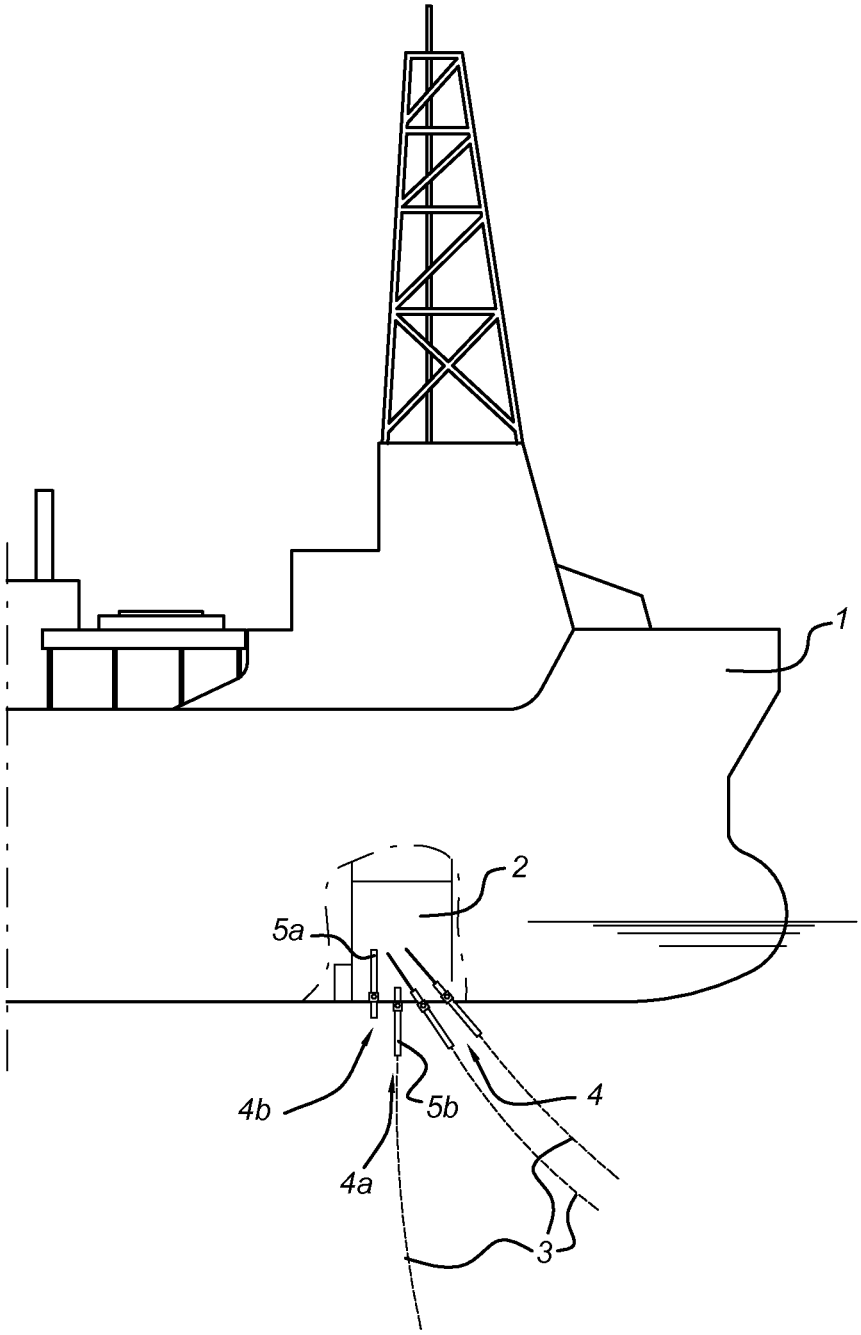
FIG. 1 shows an offshore construction comprising chain connectors according to the present invention with some connectors which are in a retracted position and others which are not.
Figure 2:
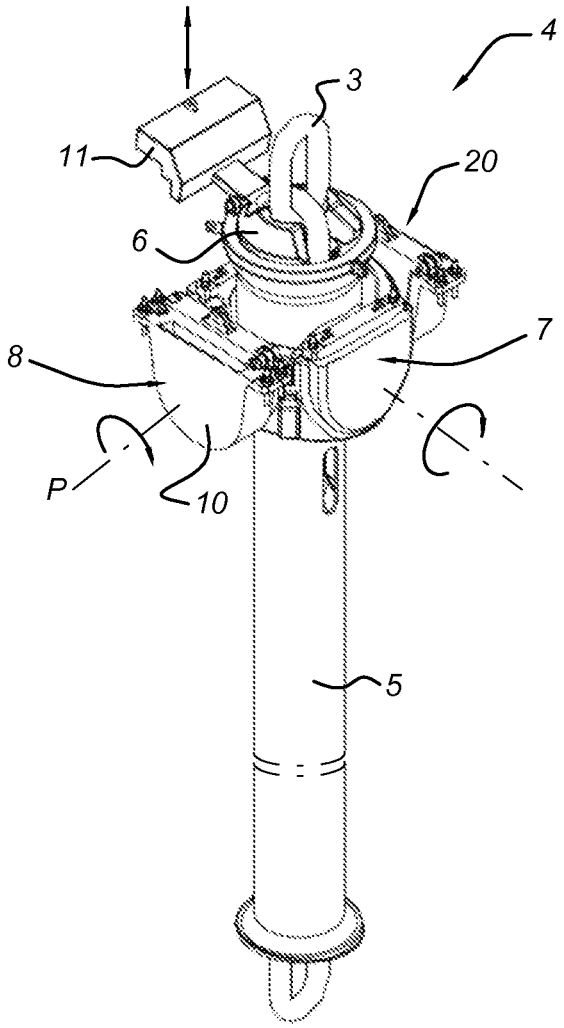
FIG. 2 shows an overview of a connector according to the present invention.
Figure 3A:
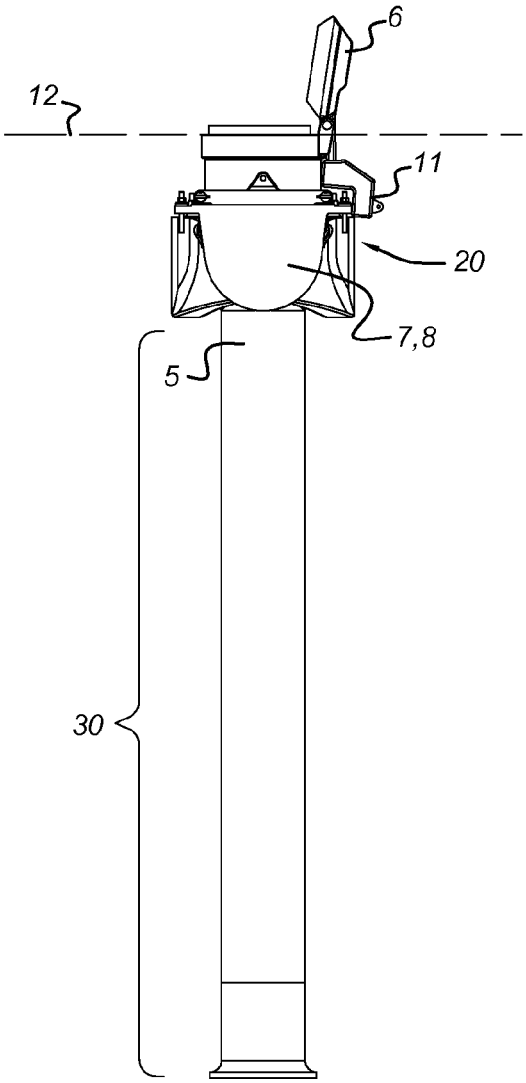
FIGS. 3*a* and 3*b* show side view of a connector according to one possible embodiment of the present invention when the movable part is not retracted and when the movable part is retracted.
Figure 3B:
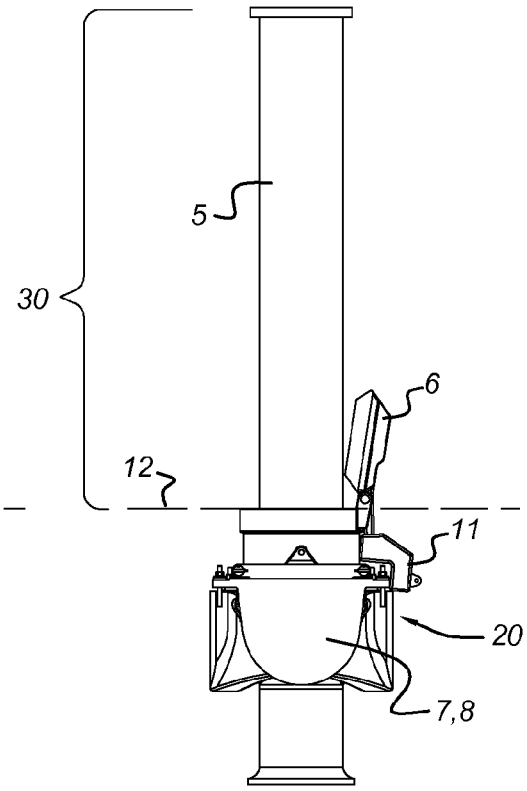
Figure 3C:
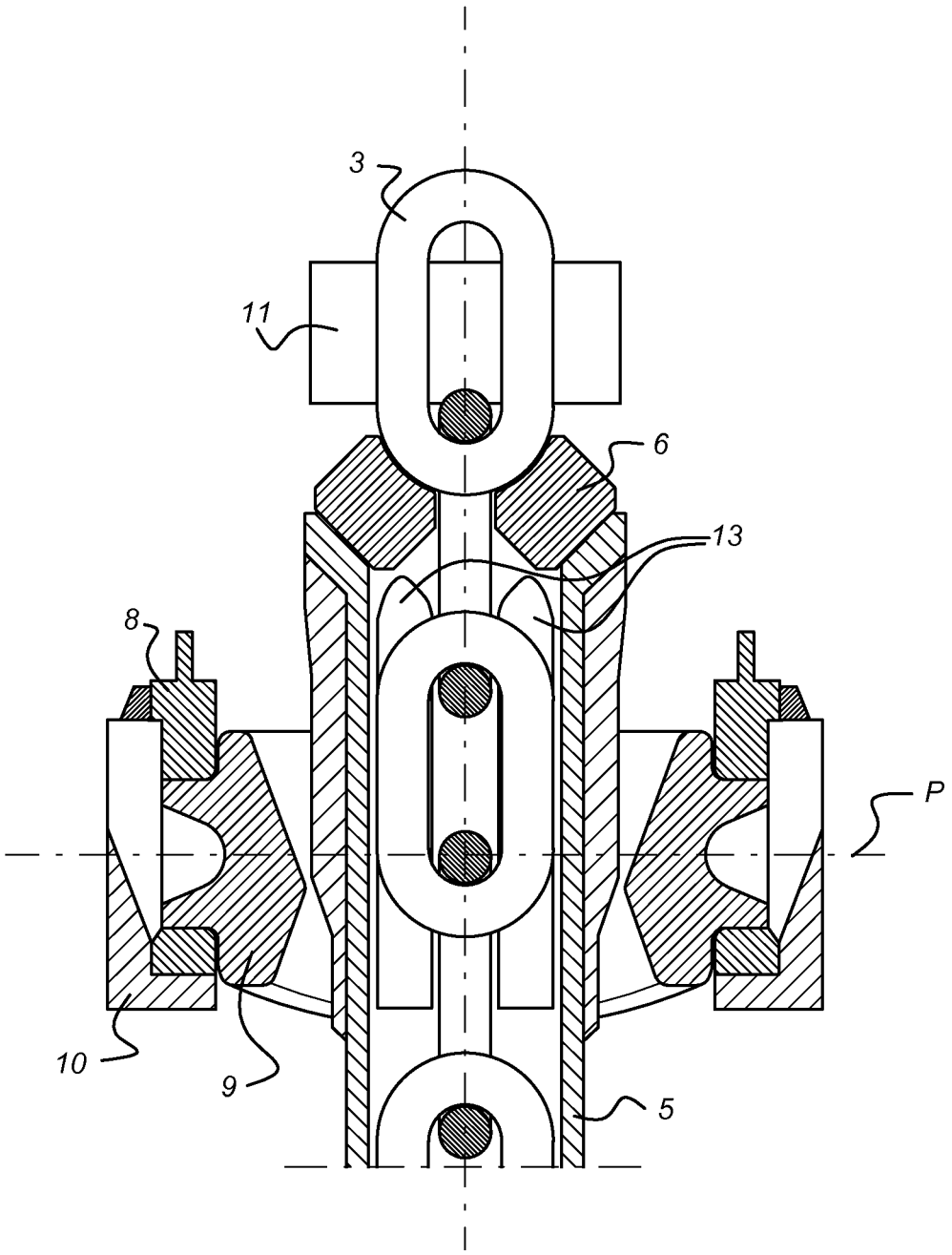
FIG. 3*c* shows a cross-section of a chain connector.

In FIG. 3*c*, a cross-section of a chain connector according to the present invention is shown. The moveable part 30 is positioned in its extended (not retracted) position below the fixed part 20 as in FIG. 3*a*. The chain 3 is shown locked by the ratchet 6, while the counterweight 11 is held in upper position. In this figure it is clearly shown that the mooring line 3 passes through the connector and direct re-tensioning without requiring the assistance of a support vessel is possible. The chain part 3 of the mooring leg passes through the elongate tubular member 5 and the top link is stopped by the ratchet 6 which is seated on the upper part of the roll body 7. This latter is advantageous as the load is transferred to the structure and not to the housing as it is the case when the ratchet is located at the bottom of the housing. The roll body 7 is pivotably connected to the roll block 9 by a hinge (not shown) with pivot axis perpendicular to the plane of the drawing. The misalignment between the connector and the tension is created by the friction torque in the articulations. The critical links of the mooring chain 3 are protected by allowing the realignment of the connector with tension, i.e. by defining a lever arm length so that the tension creates a moment to overcome the friction torque. The lever arm is defined as the distance between the articulation axis and the contact point for the rotation considered at the ratchet location. Due to the design of the chain connector, links are liable to undergo combined tension, out of plane bending and in plane bending stresses for the first links outside the chain guide casting. To protect them, the connector should start to rotate (both pitch and roll directions) before the critical moment is reached into the first links outside. This can be achieved by adjusting the length of the tubular element 5. The gap between the bottom of the elongate tubular element 5 and chain 3 determines the angular span allowed between the locked link and the first rotating link. Limiting this angle enables to control the out of plane moment range in the links and hence the stress that combines with tension. Should the gap at the pipe bottom be closed the first links undergoing combined stresses would be the links just outside the pipe.

Ideally closing the gap at the bottom of the elongate tubular element could avoid the chain from touching the elongated tubular member under the tension conditions applied to it when the floating device is moored. In that case, the first links undergoing combined stresses would be the links just outside the tubular element, it would hence be possible to control the out of plane bending completely.

The roll block 9 is pivotably connected by trunnions to the pitch body 8 with pivot axis as indicated dashed line P, clearly showing that the pitch and the roll articulations 8, 9 axes are coplanar which prevents moments from being transferred from one articulation to the other. Further it is shown that the trunnions are positioned within the housing 10.

Figure 4:
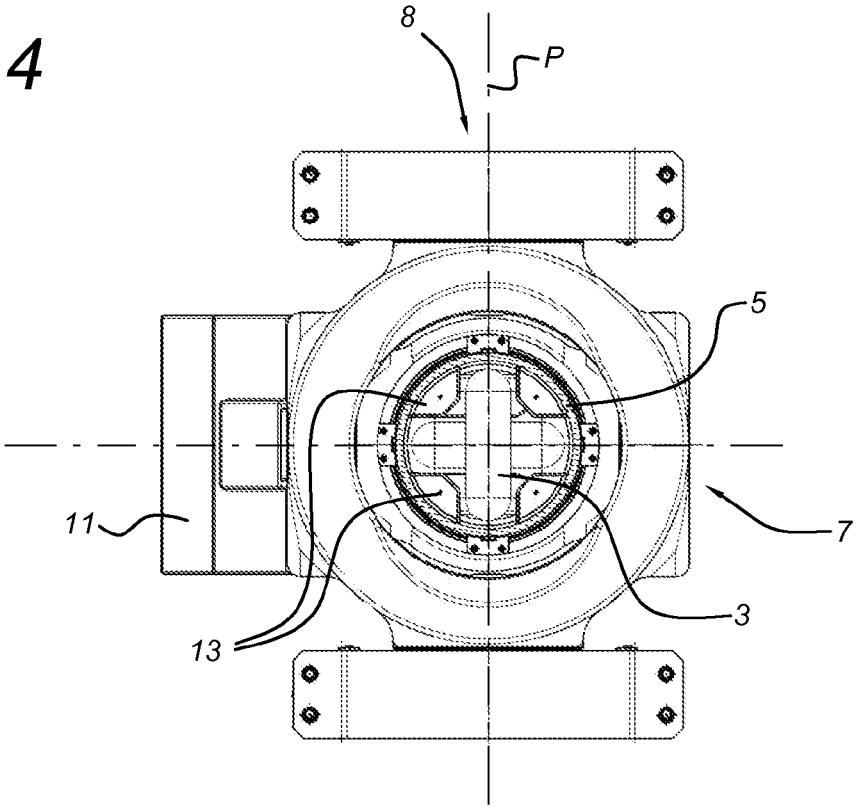
FIG. 4 shows a top view of a connector according to the present invention.

FIG. 4 shows a top view of a connector according to the present invention. In this FIG. 4 it is clearly shown that the cathodic protections 13 are placed inside the elongate tubular member 5. This configuration enables to have the protections closer to the links of the chain 3 and hence better protect the chain 3 against the corrosion in order to improve the fatigue life. Further, spaces created inside the tubular member 5 to receive the cathodic protections 13 are also used as means for positioning and maintaining the chain (guiding element 13) into the right position inside the connector 4. This chain guide element 13 located within the elongate tubular member 5 has a cruciform shape opening and is placed just before the ratchet 6, as clearly shown in FIGS. 4 and 3*c* which enable to ensure the links of the mooring chain 3 are properly positioned at the latch mechanism location which in turn eases and secures the locking of the chain 3 by the ratchet 6.

Figure 5:
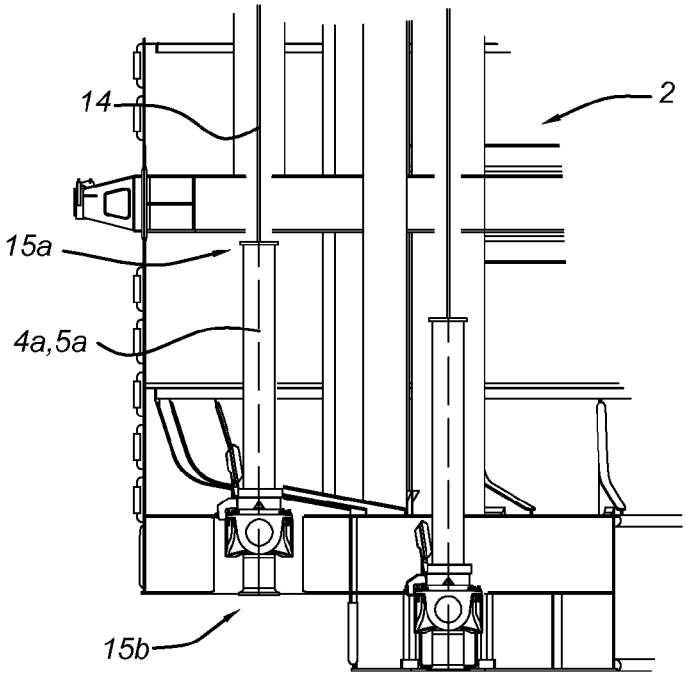
FIG. 5 shows a connector according to the invention, while a pick-up line has been connected.

FIG. 5 shows the connector 4 once the pick-up line 14 has been connected to the centering and stabilizing means 15. It appears clearly that the centering means 15*b* enables an optimum positioning of the line while pulling on it to retract the connector. The stabilizing means 15*b* can be of any type such as a clump weight. It needs to have a sufficient weight to lower the center of gravity for an enhanced retraction using a winch (not shown) installed on the vessel 1. The stabilizing means needs to have a volume sufficient to block the bottom part of the elongate element 5 in order to initiate the move of the latest when pulling further on the line 14.

Figure 6:
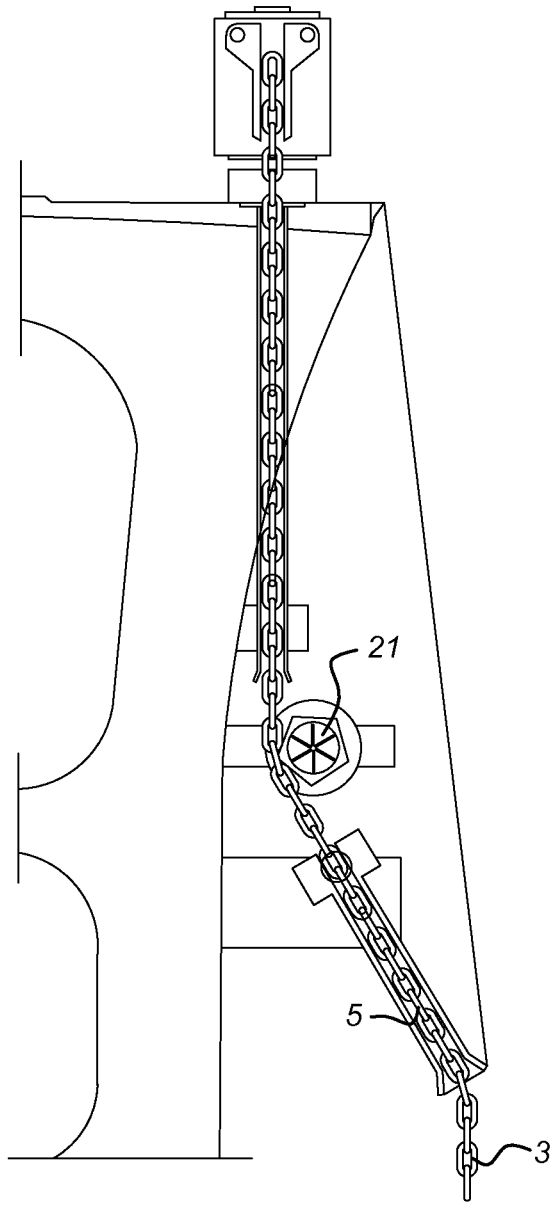
FIG. 6 shows the connector according to one embodiment of the present invention for a spread moored floating device.

FIG. 6 shows the connector according to one embodiment of the present invention for a spread moored floating device.

In this embodiment the mooring chain connector assembly is arranged in a spread moored floating device. The mooring chain connector assembly comprises for each mooring line 3 a guiding wheel 21 and a fairlead installed on the hull of the floating device in combination with a chain connector.

As mentioned above, the solution proposed is ideal for a weathervaning floating device but is also easily adaptable for a spread moored floating device. For a spread moored device there is a need to reorient the chain towards the pulling system. Therefore the chain connector as described above is combined with a guiding wheel and a fairlead installed along the hull. The assembly of this embodiment enables to use a chain connector according to the invention for a spread moored installation (FIG. 6).

Although particular embodiments of the invention have been described and illustrated herein, it is recognized that modifications and variations may readily occur to those skilled in the art, and consequently, it is intended that the claims be interpreted to cover such modifications and equivalents.

The invention claimed is:

1. A mooring leg connector (4) for use with a mooring chain part (3) of a mooring leg extending up from the sea floor to moor a floating structure (1) to the seabed, said connector (4) having an elongate tubular element (5) extending in the mooring leg direction and a latch mechanism (6) for fixation of the mooring chain part (3) to the floating structure to be moored and preventing movement along the mooring leg in the direction of the seabed, the elongate tubular element (5) has a passage for the mooring chain to pass through and comprises at the top a double articulation axis comprising a roll articulation (7) and a pitch articulation (8) characterized in that the roll and pitch articulations are coplanar.

2. A mooring leg connector (4) according to claim 1 wherein the double articulation axis comprises a roll body (7) that rolls inside a pitch body (8) which pitches inside roll blocks (9) by means of trunnions.

3. A mooring leg connector (4) according to claim 2 wherein the latch mechanism (6) is resting on the top of the roll body (7).

4. A mooring leg connector (4) according to claim 1 wherein an element is placed at the bottom of the elongate tubular element (5) in order to close the gap between the bottom end of the elongate tubular element (5) and the mooring chain passing through.

5. A mooring leg connector (4) according to claim 1 wherein the passage in the elongate tubular element (5) for the mooring chain to pass through comprises a guiding element (13) with a cruciform shape opening which is placed just before the latch mechanism (6).

6. Mooring chain connector assembly for a spread moored floating device comprising for each mooring line a guiding wheel and a fairlead installed on the hull of the floating device in combination with a chain connector according to claim 1.

7. A mooring leg connector (4) according to claim 2 wherein an element is placed at the bottom of the elongate tubular element (5) in order to close the gap between the bottom end of the elongate tubular element (5) and the mooring chain passing through.

8. A mooring leg connector (4) according to claim 3 wherein an element is placed at the bottom of the elongate tubular element (5) in order to close the gap between the bottom end of the elongate tubular element (5) and the mooring chain passing through.

9. A mooring leg connector (4) according to claim 2 wherein the passage in the elongate tubular element (5) for the mooring chain to pass through comprises a guiding element (13) with a cruciform shape opening which is placed just before the latch mechanism (6).

10. A mooring leg connector (4) according to claim 3 wherein the passage in the elongate tubular element (5) for the mooring chain to pass through comprises a guiding element (13) with a cruciform shape opening which is placed just before the latch mechanism (6).

11. A mooring leg connector (4) according to claim 4 wherein the passage in the elongate tubular element (5) for the mooring chain to pass through comprises a guiding element (13) with a cruciform shape opening which is placed just before the latch mechanism (6).

* * * * *